US011806567B2

(12) United States Patent
Beckish

(10) Patent No.: US 11,806,567 B2
(45) Date of Patent: Nov. 7, 2023

(54) ARM-TRAINING DEVICE

(71) Applicant: Recover Strong LLC, Golden, CO (US)

(72) Inventor: Kelli Avonne Beckish, Golden, CO (US)

(73) Assignee: Recover Strong LLC, Golden, CO (US)

( * ) Notice: Subject to any disclaimer, the term of this patent is extended or adjusted under 35 U.S.C. 154(b) by 0 days.

(21) Appl. No.: 17/774,973

(22) PCT Filed: Nov. 9, 2020

(86) PCT No.: PCT/US2020/059692
§ 371 (c)(1),
(2) Date: May 6, 2022

(87) PCT Pub. No.: WO2021/092566
PCT Pub. Date: May 14, 2021

(65) Prior Publication Data

US 2022/0401784 A1 Dec. 22, 2022

Related U.S. Application Data

(60) Provisional application No. 62/932,295, filed on Nov. 7, 2019.

(51) Int. Cl.
*A63B 21/00* (2006.01)
*A63B 21/04* (2006.01)
(Continued)

(52) U.S. Cl.
CPC .... *A63B 21/00185* (2013.01); *A63B 21/0428* (2013.01); *A63B 21/0555* (2013.01);
(Continued)

(58) Field of Classification Search
CPC ..... A63B 21/00185; A63B 21/0428; A63B 21/0555; A63B 21/0557; A63B 21/4017; A63B 23/12; A63B 2225/09
See application file for complete search history.

(56) References Cited

U.S. PATENT DOCUMENTS 1,655,092 A * 1/1928 Brown ..... A63B 69/0059 473/212
1,884,392 A * 10/1932 Treat ..... A63B 21/0552 482/126

(Continued)

FOREIGN PATENT DOCUMENTS

WO WO 2018/023152 A1 2/2018

OTHER PUBLICATIONS

PCT International Patent Application No. PCT/US20/59692, International Search Report and Written Opinion of the International Searching Authority dated Mar. 10, 2021, 16 pages.

(Continued)

*Primary Examiner* — Andrew S Lo
(74) *Attorney, Agent, or Firm* — Craig R. Miles; CR MILES P.C.

(57) ABSTRACT

An arm-training device, and methods of making and using such an arm-training device, whereby the arm-training device includes a flexible elongate member having an elastic length disposed between opposing first and second ends; a first loop formed proximate the first end; a second loop formed proximate the second end; a first slide coupled to the first loop, the first slide movable along the length of the elongate member; and a second slide coupled to the second loop, the second slide movable along the length of the elongate member.

20 Claims, 6 Drawing Sheets

(51) Int. Cl.
*A63B 21/055* (2006.01)
*A63B 23/12* (2006.01)

(52) U.S. Cl.
CPC ..... *A63B 21/0557* (2013.01); *A63B 21/4017* (2015.10); *A63B 23/12* (2013.01); *A63B 2225/09* (2013.01)

(56) References Cited

U.S. PATENT DOCUMENTS 4,251,071 A * 2/1981 Norton ..... A63B 21/0004 482/125
4,257,597 A 3/1981 Pennybaker
4,685,671 A * 8/1987 Hagerman ..... A63B 21/1645 482/129
4,733,862 A * 3/1988 Miller ..... A63B 21/1609 482/125
4,735,412 A * 4/1988 Prsala ..... A63B 21/154 482/125
5,165,696 A * 11/1992 Saha ..... A63B 69/0095 273/DIG. 19
5,205,803 A * 4/1993 Zemitis ..... D07B 1/18 482/121
5,295,949 A * 3/1994 Hathaway ..... A63B 23/025 602/14
5,352,174 A * 10/1994 Mason ..... A63B 21/0004 482/904
5,498,218 A * 3/1996 Proctor ..... A63B 23/025 482/10
D368,501 S * 4/1996 Woodruff ..... D21/672
5,518,486 A 5/1996 Sheeler
5,938,548 A * 8/1999 Upshaw ..... A63B 69/0059 473/453
D438,577 S * 3/2001 Phillips ..... D21/687
6,368,255 B1 * 4/2002 Chan-Rouse ..... A63B 23/00 482/148
D630,332 S * 1/2011 Richards ..... D24/190
8,403,818 B1 * 3/2013 Wilkinson ..... F16G 11/106 482/121
9,205,299 B1 * 12/2015 Hall ..... A63B 21/0552
9,630,081 B2 * 4/2017 Gillespie ..... A63B 23/1245
10,238,908 B2 * 3/2019 Cummings ..... A63B 21/4021
11,266,866 B1 * 3/2022 Wiltshire ..... A63B 21/4035
2001/0029223 A1 * 10/2001 Kallassy ..... A63B 21/4037 482/139
2002/0072453 A1 * 6/2002 Gwyn ..... A63B 21/4025 482/92
2002/0193188 A1 * 12/2002 Wah Loh ..... A63B 69/38 473/215
2005/0239617 A1 * 10/2005 Tenaglia ..... A63B 21/0552 482/904
2008/0009398 A1 * 1/2008 Grisdale ..... A63B 21/0552 482/121
2008/0058180 A1 * 3/2008 Clarke ..... A63B 23/03508 482/126
2010/0048366 A1 * 2/2010 Lebert ..... A63B 21/0023 482/131
2010/0317495 A1 * 12/2010 DiGiovanni ..... A63B 21/151 482/129
2011/0284321 A1 11/2011 Hall et al.
2011/0306477 A1 * 12/2011 Keen ..... A63B 23/12 482/122
2012/0108403 A1 * 5/2012 Zandman-Zeman ..... A63B 21/0555 482/121
2012/0165167 A1 * 6/2012 Hauptmann ..... A63B 21/4037 482/142
2012/0309567 A1 * 12/2012 Skinner ..... A63B 65/00 473/422
2013/0012368 A1 * 1/2013 Verruto ..... A63B 21/0004 482/124
2013/0345032 A1 * 12/2013 Aldridge ..... A61H 1/0292 482/131
2014/0171275 A1 * 6/2014 Tatum ..... A63B 21/0004 482/124
2014/0200499 A1 7/2014 Champion
2015/0038270 A1 * 2/2015 Williams, Jr. ..... A63B 69/002 473/425
2015/0367159 A1 * 12/2015 Harris ..... A63B 21/00185 482/122
2016/0236026 A1 * 8/2016 Hauptmann ..... A63B 23/03575
2017/0151480 A1 * 6/2017 Wright ..... G09B 19/0038
2018/0178058 A1 * 6/2018 Fano ..... A63B 21/4023
2018/0318631 A1 * 11/2018 Siu ..... A63B 21/0442
2018/0318692 A1 * 11/2018 Guidetti ..... A41D 13/0518
2020/0023223 A1 * 1/2020 Rosenthal ..... A63B 21/4043
2021/0170219 A1 * 6/2021 Lewis ..... A63B 21/4035

OTHER PUBLICATIONS

U.S. Appl. No. 62/932,295, filed Nov. 7, 2019.

* cited by examiner

ARM-TRAINING DEVICE

This application is the United States National Stage of International Patent Cooperation Treaty Patent Application No. PCT/US20/59692, filed Nov. 9, 2020, which claims the benefit of U.S. Provisional Patent Application No. 62/932,295, filed Nov. 7, 2019, each hereby incorporated by reference herein.

I. DISCLOSURE OF THE INVENTION

A broad object of a particular embodiment of the invention can be to provide an arm-training device, and methods of making and using such an arm-training device, whereby the arm-training device includes a flexible elongate member having an elastic length disposed between opposing first and second ends; a first loop formed proximate the first end; a second loop formed proximate the second end; a first slide coupled to the first loop, the first slide movable along the length of the elongate member; and a second slide coupled to the second loop, the second slide movable along the length of the elongate member.

Naturally, further objects of the invention are disclosed throughout other areas of the specification, drawings, and claims.

II. BRIEF DESCRIPTION OF THE DRAWINGS

III. MODE(S) FOR CARRYING OUT THE INVENTION

Figure 1B:
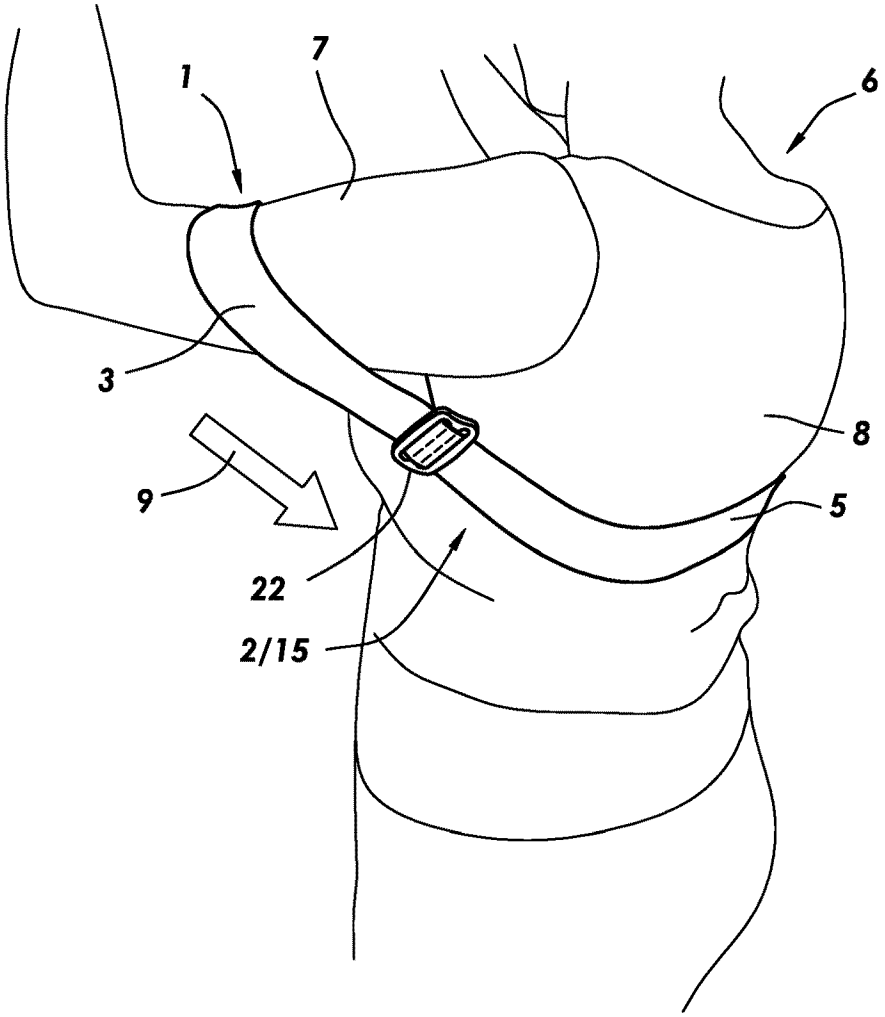
FIG. 1B is an illustration of a method of using the particular embodiment of the arm-training device shown in FIG. 1A, but whereby the arm-training device disposes in an extended state which can remind the wearer of the relative position of his or her arms to preclude undesirable movement of the arms.
Figure 1A:
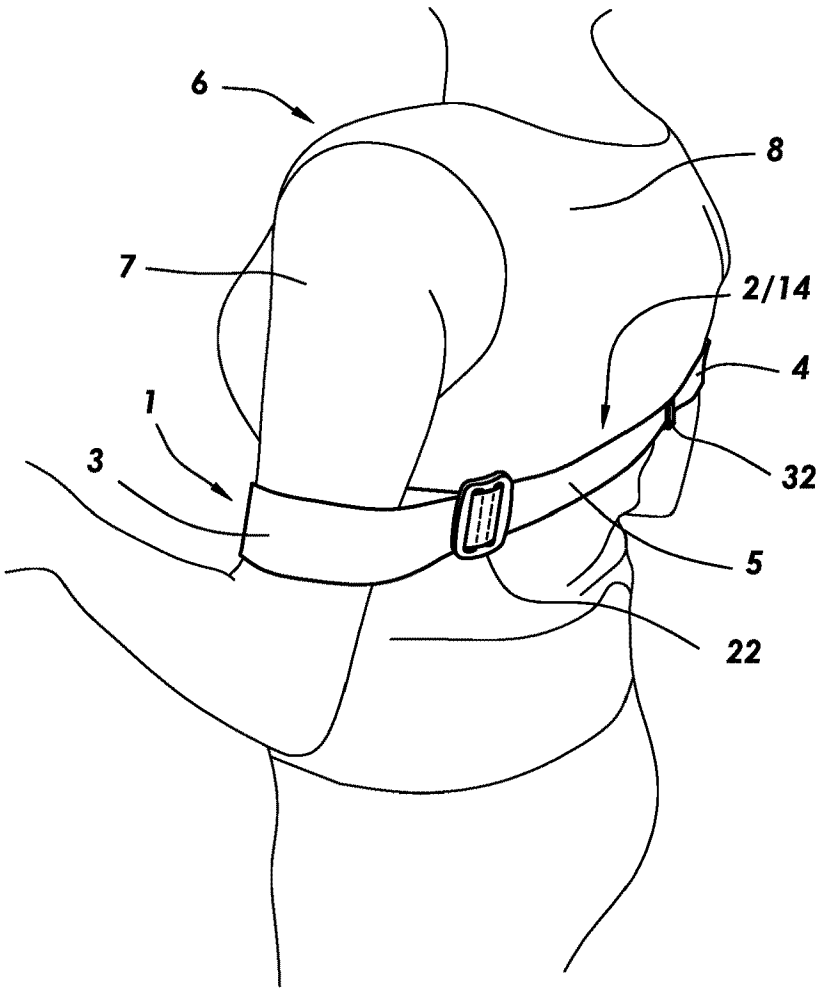
FIG. 1A is an illustration of a method of using a particular embodiment of the arm-training device, whereby the arm-training device is worn by a wearer and disposes in a relaxed state.
Figure 2:
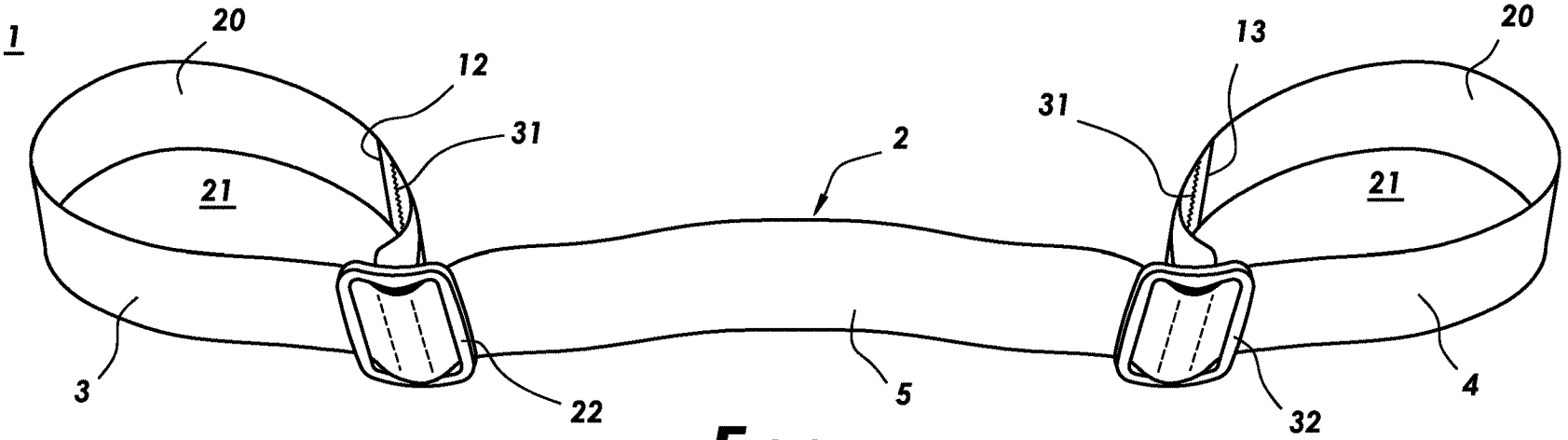
FIG. 2 is a perspective view of a particular embodiment of the arm-training device.
Figure 3:
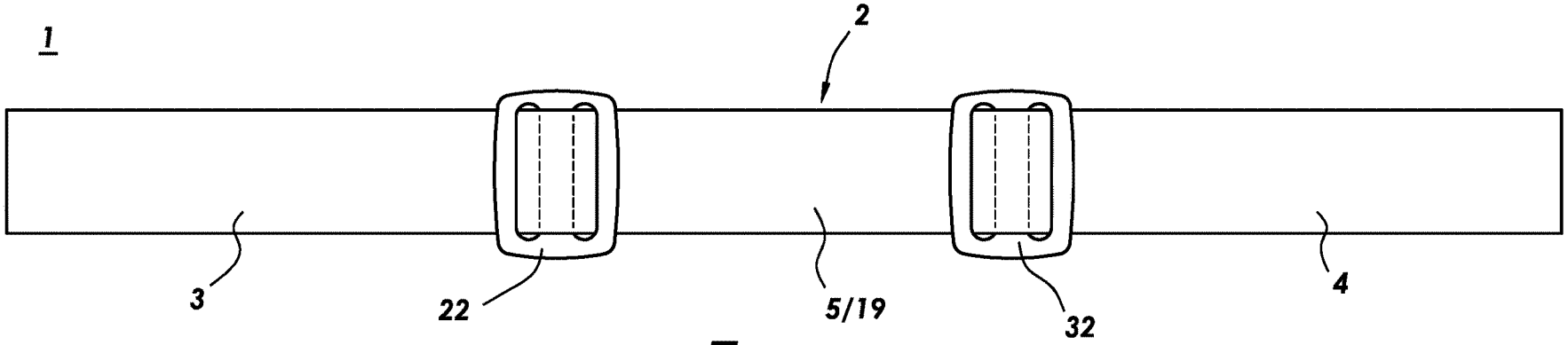
FIG. 3 is a front view of the particular embodiment of the arm-training device shown in FIG. 2.
Figure 4:
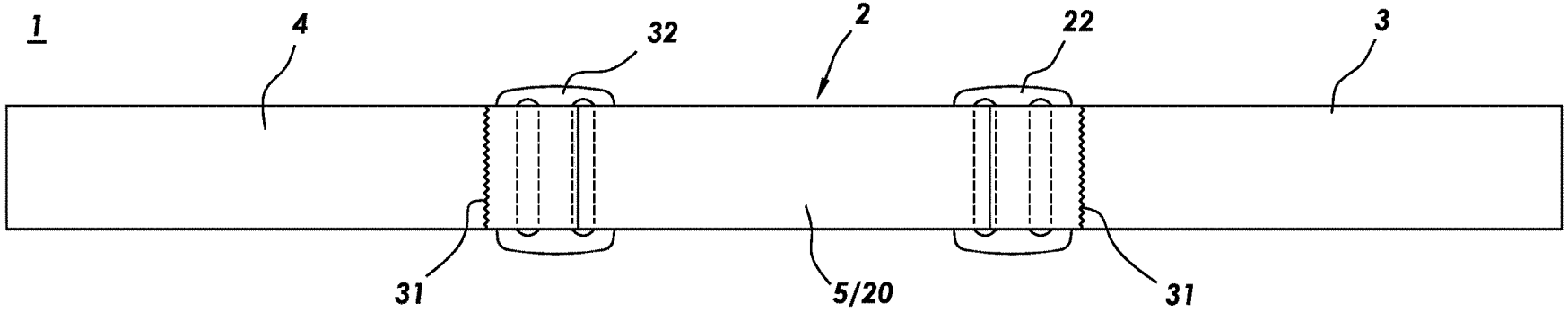
FIG. 4 is a rear view of the particular embodiment of the arm-training device shown in FIG. 2.
Figure 5:
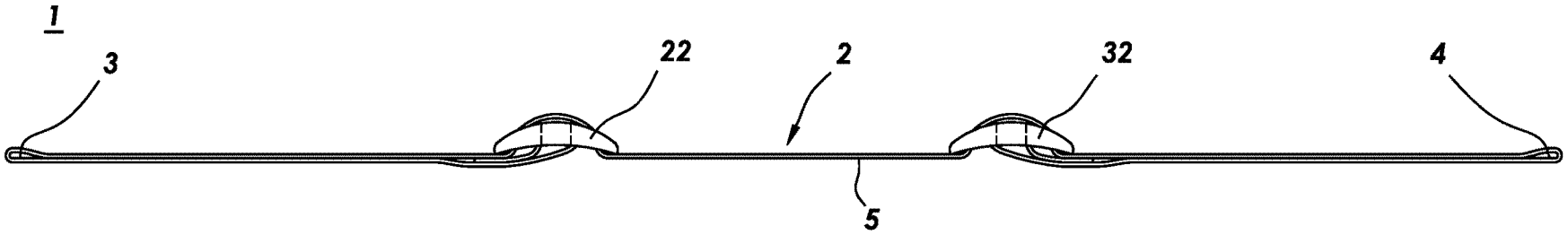
FIG. 5 is a first side view of the particular embodiment of the arm-training device shown in FIG. 2.
Figure 6:
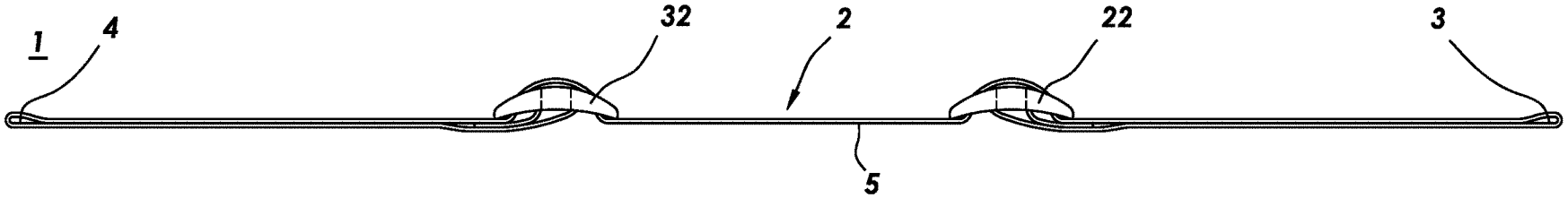
FIG. 6 is a second side view of the particular embodiment of the arm-training device shown in FIG. 2.
Figure 8:
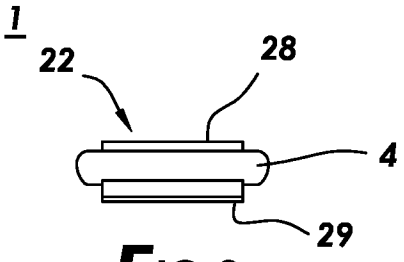
FIG. 8 is a second end view of the particular embodiment of the arm-training device shown in FIG. 2.
Figure 7:
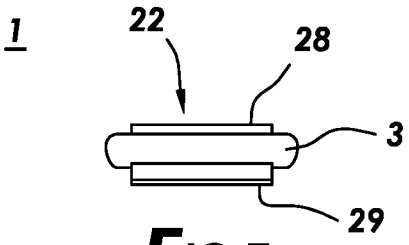
FIG. 7 is a first end view of the particular embodiment of the arm-training device shown in FIG. 2.

Now referring primarily to FIGS. 1A and 1B, which illustrate a method of using a particular embodiment of the inventive arm-training (or restraining) device (1) including a flexible elongate member (2) having opposing adjustable first and second loops (3)(4) coupled thereto and an intermediate portion (5) disposed between the first and second loops (3)(4), whereby when worn or donned by a wearer (6), each loop (3)(4) can receive an arm (7) and in particular, an upper arm portion, of a wearer (6), and the intermediate portion (5) can extend across the back (8) of the wearer (6) between the arms (7).

Notably, when worn by a wearer (6), the intermediate portion (5) does not extend across the front (or anterior portion or ventral portion) of the wearer (6), and extends only across the back (8) (or posterior portion or dorsal portion) of the wearer (6); following, when used, the arm-training device (1) may not interfere with or hinder the front of the wearer (6).

For the sake of simplicity, the arm-training device (1) will be described herein as affecting both arms (7) but, while worn about both arms (7), it is herein contemplated that the arm-training device (1) may be intended to affect only one arm (7), depending upon the circumstances.

In use, the arm-training device (1) can function to limit predetermined undesirable movement or relative positioning of one or both arms (7) by providing a pulling force (9) to the arms (7) when stretched or elongated from a lesser span (10) to a greater span (10) (for example, by undesired movement of the arms (7), this movement generating tension in the elongate member (2)). Following, the arm-training device (1) may help the wearer (6) be mindful and/or remind the wearer (6) of the relative position of their arms (7) to preclude the undesirable movement of the arms (7). Correspondingly, the arm-training device (1) may reinforce a desirable relative positioning of the arms (7) and thus, may train the wearer (6) to avoid the undesirable movement of the arms (7). Additionally, the arm-training device (1) may effectively restrain excessive relative movement of the arms (7).

Significantly, the instant arm-training device (1) does not completely restrict or inhibit arm movement in any one direction, as may be done by a pair of handcuffs. Conversely, the arm-training device (1) disclosed herein allows a predetermined first range of arm movement (corresponding to the desirable relative positioning of the arms (7)) while aiming to prevent a predetermined second range of arm movement (corresponding to the undesirable relative positioning of the arms (7)).

Concerning the predetermined undesirable and desirable movement or relative positioning of the arms (7), the term "predetermined" as used herein means established or decided in advance. For example, it may be recommended that a patient recovering from an injury or surgery not move their arms (7) forwardly and/or upwardly and/or outwardly beyond a predetermined point which may negatively affect their recovery and/or healing process. As but one detailed example, during recovery from a mastectomy, it may be recommended that (i) a patient not position their upper arm portions beyond 45° (from a 0° position in which the upper arm portions dispose straight down) for the first several weeks (such as four weeks) following surgery and then, (ii) the patient not position their upper arm portions beyond 90° for the next several weeks (such as six weeks). In such a scenario, the instant arm-training device (1) may be particularly useful for enhancing patient compliance with the recommended restrictions.

Now referring primarily to FIGS. 2 through 9C, the arm-training device (1) includes a flexible elongate member (2) whereby as used herein, the term "elongate member" may be construed as similar to or synonymous with "band" or "strip," which can mean a generally planar (or flat) piece of material having a substantially greater length than width. Due to the flexibility of the elongate member (2), it can be conformable to a wearer (6) and in particular, the elongate member (2) can conform about (i) a portion or an entirety of the circumference of the upper arm portions and (ii) the back (8) of the wearer (6).

Figure 9A:
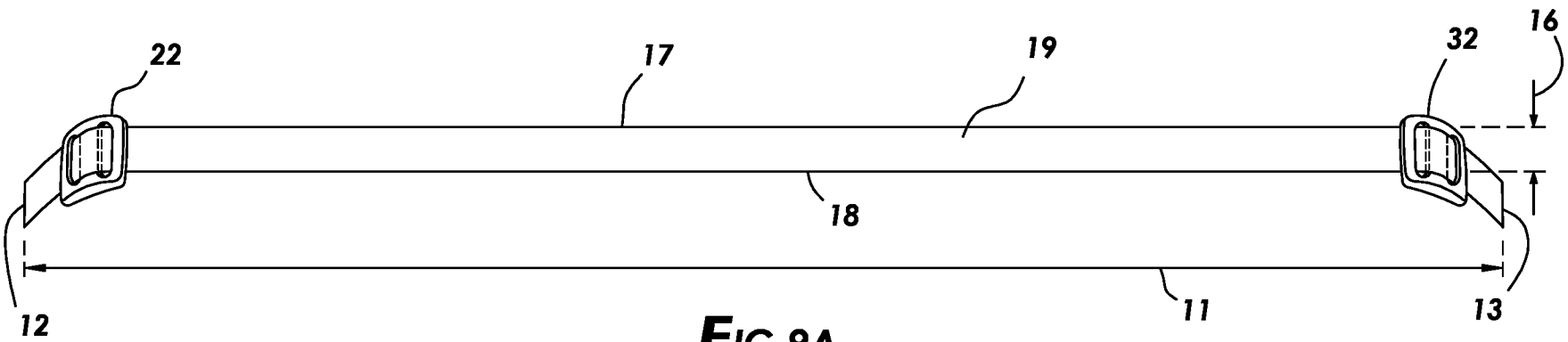
FIG. 9A is a perspective view of a particular embodiment of the arm-training device, whereby the slides are not secured to the elongate member.

Now referring primarily to FIG. 9A, the elongate member (2) can have an elastic length (11) disposed between opposing first and second ends (12)(13); thus, the length (11) can be along the longitudinal axis of the elongate member (2). As elastic, the length (11) can be resiliently stretchable between a relaxed state (14) and an extended state (15) (as shown in the examples of FIGS. 1A and 1B, respectively), whereby the extended state (15) can be generated from the relaxed state (14) by the application of tensile force that acts on the elongate member (2) along its length (11), for example by undesired movement of the arms (7). Regarding dimensions, the length (11) can be sufficient to loop around both upper arm portions and extend between both upper arm portions along the back (8) of a wearer (6), thereby connecting both arms (7) together. Of course, it is herein contemplated that various lengths of elongate members (2) may be provided for differently sized wearers (6).

As but one illustrative example, the length (11) of the elongate member (2) can be in a range of between about 30 inches to about 50 inches.

As but one illustrative example, the length (11) of the elongate member (2) can be about 40 inches.

The width (16) of the elongate member (2) may or may not be elastic, depending upon the embodiment. Concerning dimensions, the width (16) can be sufficiently large enough to preclude the elongate member (2) from cutting into the skin or irritating the adjacent tissue, which may be in contrast to a relatively narrow elongate member, such as a rope or cord or wire.

As but one illustrative example, the width (16) of the elongate member (2) can be in a range of between about 1 inch to about 3 inches.

Also for relative comfort, the elongate member (2) can be generally planar; thus, comfort against the body of the wearer (6) may be enhanced relative to an elongate member having a nonplanar surface(s), such as a rope or cord or wire, which can have a generally circular cross section and a correspondingly arcuate outer surface(s).

As to particular embodiments, the elongate member (2) can be generally rectangular (or have a generally rectangular cross-section) and can have a substantially constant width (16) along its length (11). However, the elongate member (2) need not be limited to this particular configuration.

Again referring primarily to FIG. 9A, structurally, the length (11) and width (16) of the elongate member (2) can be defined by a top edge (17) connected to an opposing bottom edge (18) by opposing left and right edges which provide the first and second ends (12)(13). The elongate member (2) further includes a front face (19) and an opposing rear face (20).

As to particular embodiments, the elongate member (2) can be a single or one-piece or monolithic or integrated construct, meaning seamlessly continuous between the first and second ends (12)(13).

The elongate member (2) can be formed from a numerous and wide variety of elastic materials which are of sufficient strength to (i) withstand the repeated stretching of the elongate member (2) along its length (11), and (ii) provide the requisite pulling force (9) to preclude the predetermined second range of arm movement (corresponding to the undesirable relative positioning of the arms (7)) while allowing the predetermined first range of arm movement (corresponding to the desirable relative positioning of the arms (7)).

Further, the elongate member (2) can be formed from a flexible and/or conformable material, which can enhance the comfort of the arm-training device (1) for the wearer (6). Additionally, the elongate member (2) can be formed from a material which may be compatible with washing, for example machine washing, and/or machine drying.

As but one illustrative example, the elongate member (2) can be formed from a textile, such as a polyester elastic webbing. Of course, the elongate member (2) is not limited to being formed from this material, and can be formed from a numerous and wide variety of materials which provide a similar or identical function.

In use, depending upon the preference of the wearer (6), the arm-training device (1) can be worn over clothing or underneath clothing.

Now referring primarily to FIGS. 2 through 9C, the elongate member (2) can be coupled to, include, or have formed therein a pair of loops and namely, a first loop (3) proximate the first end (12) and a second loop (4) proximate the second end (13), whereby an intermediate portion (5) can dispose between the first and second loops (3)(4).

Each loop (3)(4) can define an arm-receiving aperture (21) and consequently, can be configured or sized to extend about the arm (7) of a wearer (6) and specifically, around an upper arm portion, whereby the loop (3)(4) can entirely surround the upper arm portion.

In addition to surrounding the upper arm portion, the loop (3)(4) can also conform about the curved shape of the upper arm portion as a result of its flexibility and/or conformability, thereby providing a relatively comfortable fit on the arm (7) of a wearer (6).

As to particular embodiments, each loop (3)(4) can be formed from the elongate member (2), for example by overlayingly engaging portions of the elongate member (2) to generate a generally planar loop such that the rear faces (20) of the overlaying portions of the elongate member (2) dispose adjacent one another and directly define the arm-receiving aperture (21). In this configuration, the top edges (17) of the overlaying portions of the elongate member (2) can align with one another and the bottom edges (18) of the overlaying portions of the elongate member (2) can align with one another. Further, in this embodiment, while the loops (3)(4) can be formed from overlaying portions of the elongate member (2) (thus making a planar loop two layers thick), the intermediate portion (5) can be only one layer thick.

As to particular embodiments, the arm-training device (1) can further include a first slide (22) coupled to the first loop (3), whereby the first slide (22) can be movable along the length (11) of the elongate member (2) to allow adjustment of (i) the size (or circumference) of the first loop (3) and/or the span (10) of the elongate member (2).

As to particular embodiments, the first slide (22) can be coupled, connected, or directly connected to the elongate member (2) to form the first loop (3).

Figure 11A:
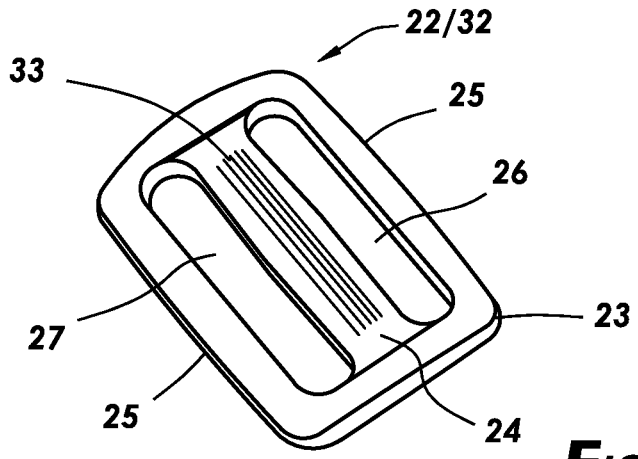
FIG. 11A is a perspective view of a particular embodiment of a slide of the arm-training device.
Figure 11B:
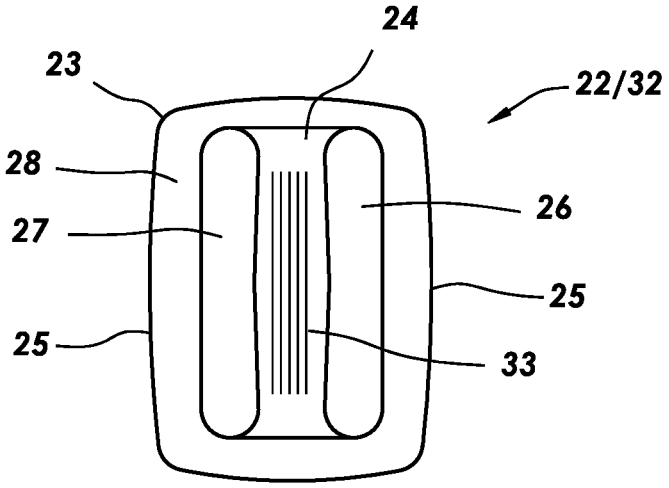
FIG. 11B is a front view of the particular embodiment of the slide shown in FIG. 11A.
Figure 11C:
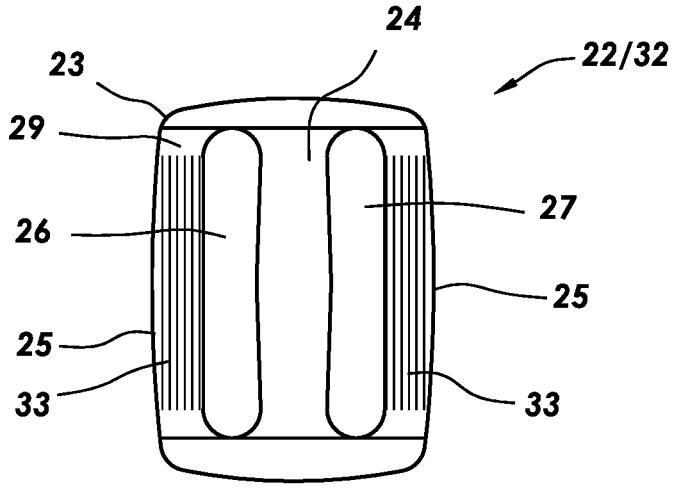
FIG. 11C is a rear view of the particular embodiment of the slide shown in FIG. 11A.

Now referring primarily to FIG. 11A through 11C, the first slide (22) can include a peripheral frame (23) with an intermediate divider (24) and outer sides (25) defining laterally adjacent first and second openings (26)(27). Moreover, the first slide (22) can include opposing front and rear faces (28)(29).

As to particular embodiments, the divider (24) can be movably attached to the frame (23) such that the divider (24) can laterally move between the outer sides (25) (not shown).

As to other particular embodiments, the divider (24) can be fixedly disposed within the frame (23), thus precluding lateral movement between the outer sides (25). As to these embodiments, the first slide (22) can be a single or one-piece or monolithic or integrated construct.

As to particular embodiments, the divider (24) can provide first and second openings (26)(27) which may be equal in size and shape.

Figure 10B:
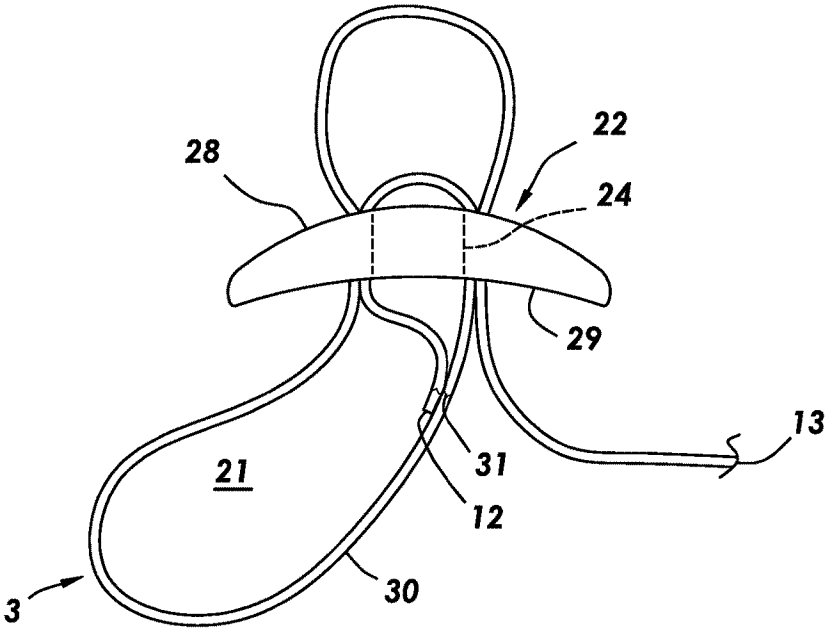
FIG. 10B is a perspective view of the elongate member of the arm-training device coupled to a slide such that the elongate member (i) is secured about the slide's divider and (ii) forms a loop.
Figure 10A:
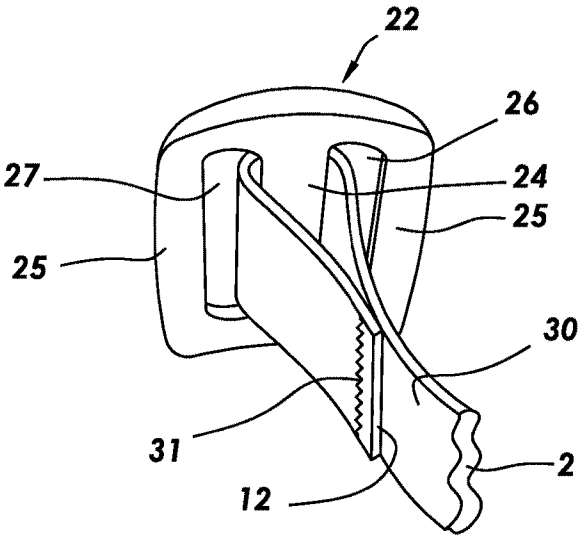
FIG. 10A is a perspective view of the elongate member of the arm-training device coupled to a slide and secured about the divider of the slide.

Now referring primarily to FIG. 10A, the first end (12) of the elongate member (2) can be coupled, connected, or directly connected to the first slide (22) and in particular, to the divider (24) of the first slide (22). For example, the first end (12) can be coupled to the divider (24) by passing the first end (12) through the first opening (26) (for example, from a rearward toward a frontward direction), over the front face (28) of the divider (24), and through the second opening (27) (for example, from a frontward toward a rearward direction), and then securing the first end (12) about the divider (24), such as by coupling the first end (12) to an inner portion (30) of the elongate member (2) by means of a fastener (31), such as by sewing the two together to generate stitches. Of course, it should be understood that the first end (12) can be secured about the divider (24) by various different processes (not necessarily sewn to an inner portion (30) of the elongate member (2)) so long as the end result fixedly secures the first end (12) about the divider (24).

It may be desirable that the fastener (31), upon securing the first end (12) about the divider (24), be substantially flush with the elongate member (2), as opposed to outwardly extending from the elongate member (2), as an outwardly extending fastener may be a source of discomfort to the wearer (6).

Importantly, while the divider (24) of the first slide (22) may be fixedly coupled to the first end (12), the first slide (22) can move or slide along the length (11) of the elongate member (2) in both lateral directions, which may be in contrast to a fastener which can move in only one direction and is prohibited from movement in the opposite direction.

Advantageously, movement of the first slide (22) in both directions along the length (11) of the elongate member (2) a permits adjustment of (i) the size of the first loop (3) and/or (ii) the span (10) of the elongate member (2), correspondingly allowing adjustment of the pulling force (9) applied to the arms (7) by the tension generated in the elongate member (2).

Now referring primarily to FIG. 10B, once the first end (12) of the elongate member (2) is secured about the divider (24) of the first slide (22), the first loop (3) can be formed via the first slide (22) from an inner portion (30) of the elongate member (2) proximate the first end (12). For example, the second end (13) of the elongate member (2) can be passed through the second opening (27) (for example, from a rearward toward a frontward direction), over the front face (28) of the divider (24), and through the first opening (26) (for example, from a frontward toward a rearward direction). As a result, the first loop (3) can be formed proximate the rear face (29) of the first slide (22), whereby the size of the first loop (3) and the span (10) of the elongate member (2) can be adjusted by varying the amount of the elongate member (2) which is passed through the second and first openings (27)(26) of the first slide (22); of course, this amount can correspond with the position of the first slide (22) along the length (11) of the elongate member (2).

Figure 9B:
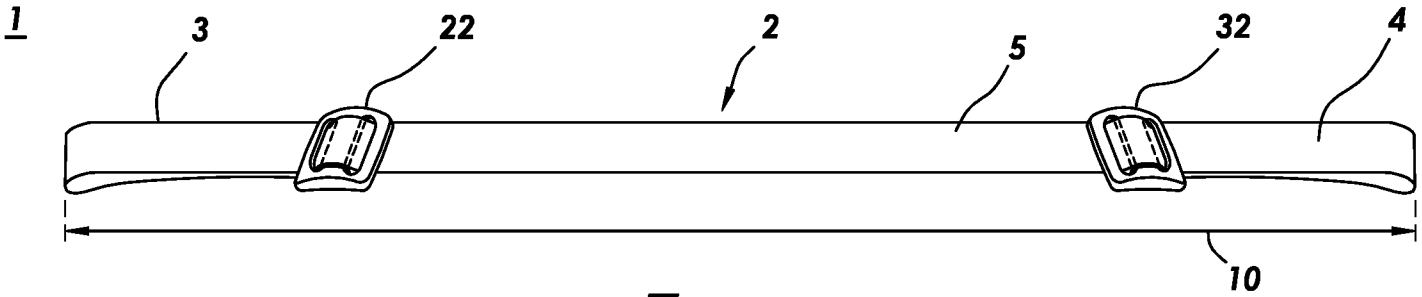
FIG. 9B is a perspective view of a particular embodiment of the arm-training device, whereby the slides are disposed relatively farther apart from one another than the slides of FIG. 9C, thus increasing the corresponding span of the elongate member.
Figure 9C:
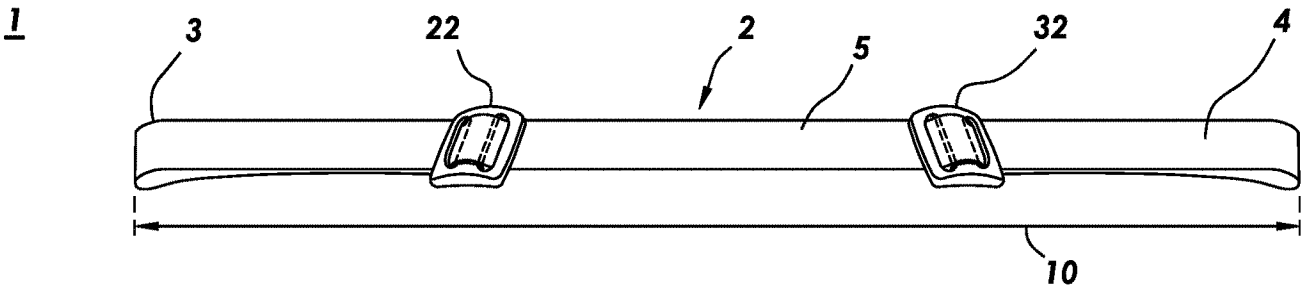
FIG. 9C is a perspective view of the particular embodiment of the arm-training device shown in FIG. 9B, but whereby the slides are disposed relatively closer together than the slides of FIG. 9B, thus decreasing the corresponding span of the elongate member.

For example, when a greater amount of the elongate member (2) is passed through the second and first openings (27)(26) of the first slide (22) after securement of the first end (12) about the divider (24), a first loop (3) with a relatively lesser size will result and the first slide (22) will dispose relatively farther from the middle of the length (11) of the elongate member (2) (as shown in the example of FIG. 9B relative to FIG. 9C). Accordingly, the span (10) of the elongate member (2) is relatively greater, thereby decreasing tension in the elongate member (2) when the loops (3)(4) are disposed about the arms (7) of the wearer (6) and the wearer (6) moves his or her arms (7) forwardly, upwardly, outwardly, or a combination thereof, thus applying a lesser pulling force (9) to the arms (7) in an opposite direction, such as rearwardly, downwardly, inwardly, or a combination thereof.

Conversely, when a lesser amount of the elongate member (2) is passed through the second and first openings (27)(26) of the first slide (22) after securement of the first end (12) about the divider (24), a first loop (3) with a relatively greater size will result and the first slide (22) will dispose relatively nearer to the middle of the length (11) of the elongate member (2) (as shown in the example of FIG. 9C relative to FIG. 9B). Consequently, the span (10) of the elongate member (2) is relatively lesser, thereby creating increased tension in the elongate member (2) when the loops (3)(4) are disposed about the arms (7) of the wearer (6) and the wearer (6) moves his or her arms (7) forwardly, upwardly, outwardly, or a combination thereof, accordingly applying a greater pulling force (9) to the arms (7) in an opposite direction, such as rearwardly, downwardly, inwardly, or a combination thereof.

Now referring primarily to FIGS. 2 through 9C, the arm-training device (1) can further include a second slide (32) coupled to the second loop (4), whereby the second slide (32) can be movable along the length (11) of the elongate member (2) to allow adjustment of (i) the size (or circumference) of the second loop (4) and/or the span (10) of the elongate member (2). As to particular embodiments, the second slide (32) can be similar or identical to the first slide (22) detailed above; thus, the above description of the first slide (22) may be extrapolated to the second slide (32).

By having two slides (22)(32), one proximate each end (12)(13) of the elongate member (2), the pulling force (9) applied to each arm (7) can be independently adjusted, as the tension can be differentially distributed. For example, by sliding the first slide (22) along the length (11) to dispose the first slide (22) relatively nearer to the middle of the length (11) of the elongate member (2) and sliding the second slide (32) along the length (11) to dispose the second slide (32) relatively farther from the middle of the length (11) of the elongate member (2), a greater pulling force (9) may be applied to the arm (7) received within the first loop (3) in relation to the arm (7) received within the second loop (4).

Additionally, by having the slides (22)(32) disposed proximate the ends (12)(13), it may be easier for the wearer (6) to adjust the slides (22)(32), for example via sliding along the length (11) of the elongate member (2) when the arm-training device (1) is being worn. In contrast, a similar device having a medially or centrally located buckle which, when in use, would dispose proximate the middle of the wearer's back, may only be conducive to adjustment or movement by a wearer when the device is removed from the wearer.

The slide (22)(32) can be formed from a numerous and wide variety of materials which are of sufficient strength to withstand the repeated stretching of the elongate member (2) along its length (11). As to particular embodiments, the slide (22)(32) can be formed from a semirigid or flexible or conformable material, which can enhance the comfort of the arm-training device (1) for the wearer (6), as a rigid slide, for example formed from a rigid metal, may be relatively less comfortable. Also, the slide (22)(32) can be formed from a material which may be compatible with washing, for example machine washing, and/or machine drying.

The slide (22)(32) can have a numerous and wide variety of configurations, provided the functionality remains similar to or the same as that of the slide (22)(32) disclosed herein.

As but one illustrative example, the slide (22)(32) can be configured as a tri-bar buckle.

As but one illustrative example, the slide (22)(32) can be a Heavy Duty Sliplok®, which can be obtained from Duraflex®.

Of course, it should be understood that the slide (22)(32) may be configured differently from the examples disclosed herein without departing from the scope of the invention.

As to particular embodiments, one or more frictional elements (33) can be coupled to the slide (22)(32). As but one illustrative example, a plurality of frictional elements (33) can be coupled to the front face (28) of the divider (24) (as shown in the example of FIG. 11B) to enhance the frictional engagement between the front face (28) of the divider (24) and the rear face (20) of the elongate member (2). As but a second illustrative example, a plurality of frictional elements (33) can be coupled to the rear face (29) of the slide (22)(32) proximate the outer sides (25) (as shown in the example of FIG. 11C) to enhance the frictional engagement between the rear face (29) of the slide (22)(32) and the front face (19) of the elongate member (2).

As to particular embodiments, the frictional elements (33) can be configured as protrusions outwardly extending from a face (28)(29) of the slide (22)(32) in spaced apart relation.

Now regarding production, a method of making a particular embodiment of the arm-training device (1) can include providing a flexible elongate member (2) having opposing adjustable first and second loops (3)(4) and an intermediate portion (5) therebetween, whereby when worn or donned by a wearer (6), each loop (3)(4) can receive an arm (7) and in particular, an upper arm portion, of a wearer (6), and the intermediate portion (5) can extend across the back (8) of the wearer (6) between the arms (7).

The method of making particular embodiments of the arm-training device (1) can further include one or more additional steps as described above and in the claims.

Now concerning use, a method of using a particular embodiment of the arm-training device (1) is described above. However, it is herein noted that to wear or don the instant arm-training device (1), the wearer (6) need not raise their arms (7) straight up, which could be considered undesirable movement or relative positioning of the arms (7). Instead, the wearer's arms (7) could remain at an angle of less than about 45° while one arm (7) is placed through the first loop (3), the other arm (7) is placed through the second loop (4), and the elongate member (2) is moved upwardly to position the loops (3)(4) proximate the upper arm portions with the intermediate portion (5) extending therebetween across the wearer's back (8).

The method of using particular embodiments of the arm-training device (1) can further include one or more additional steps as described above and in the claims.

As can be easily understood from the foregoing, the basic concepts of the present invention may be embodied in a variety of ways. The invention involves numerous and varied embodiments of an arm-training device and methods for making and using such an arm training device.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or a method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in Merriam-Webster's Dictionary, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about", it will be understood that the particular value forms another embodiment. The term "about" generally refers to a range of numeric values that one of skill in the art would consider equivalent to the recited numeric value or having the same function or result. Similarly, the antecedent "substantially" or "generally" means largely, but not wholly, the same form, manner or degree and the particular element will have a range of configurations as a person of ordinary skill in the art would consider as having the same function or result. When a particular element is expressed as an approximation by use of the antecedent "substantially" or "generally", it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant should be understood to claim at least: (i) each embodiment of the arm-training device herein disclosed and described, (ii) the related methods disclosed and described, (iii) similar, equivalent, and even implicit variations of each of these apparatuses and methods, (iv) those alternative embodiments which accomplish each of the functions shown, disclosed, or described, (v) those alternative designs and methods which accomplish each of the functions shown as are implicit to accomplish that which is disclosed and described, (vi) each feature, component, and step shown as separate and independent inventions, (vii) the applications enhanced by the various systems or components disclosed, (viii) the resulting products produced by such systems or components, (ix) methods and apparatuses substantially as described hereinbefore and with reference to any of the accompanying examples, and (x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of embodiments of the invention and are not to be construed as the broadest embodiment of the invention or a complete listing of embodiments of the invention that may be claimed. The applicant does not waive any right to develop further claims based upon the description set forth above or in the drawings as a part of any continuation, division, continuation-in-part, or similar application.

The invention claimed is:

1. An arm-training device comprising, a flexible elongate member having opposing first and second ends, wherein said elongate member has a continuous elastic length from said first end to said second end;

a first loop formed proximate said first end;

a second loop formed proximate said second end;

each of said first and second loops:

formed by overlayingly engaging portions of said elongate member; and generally planar such that rear faces of said overlayingly engaging portions dispose adjacent one another and directly define an arm-receiving aperture;

an intermediate portion disposed between said first and second loops;

a first slide coupled to said first loop, said first slide movable along said length;

said first end looped about a divider of said first slide and fixedly secured to a portion of said elongate member; and a second slide coupled to said second loop, said second slide movable along said length;

said second end looped about a divider of said second slide and fixedly secured to a portion of said elongate member.

2. The arm-training device of claim 1, said length resiliently stretchable between a relaxed state and an extended state.

3. The arm-training device of claim 2, said extended state generated from said relaxed state by the application of tensile force that acts on said elongate member along said length.

4. The arm-training device of claim 1, said length in a range of between about 30 inches to about 50 inches.

5. The arm-training device of claim 1, said elongate member having a width in a range of between about 1 inch to about 3 inches.

6. The arm-training device of claim 1, said elongate member generally planar.

7. An arm-training device comprising, a flexible elongate member having opposing first and second ends, wherein said elongate member has a continuous elastic length from said first end to said second end;

a first loop formed proximate said first end;

a second loop formed proximate said second end;

a first slide coupled to said first loop, said first slide movable along said length;

said first slide comprising a peripheral frame with an intermediate divider and outer sides defining laterally adjacent first and second openings;

said first end looped about said divider and fixedly secured to a portion of said elongate member; and a second slide coupled to said second loop, said second slide movable along said length.

8. The arm-training device of claim 7, said second end of said elongate member coupled to said second slide.

9. The arm-training device of claim 7, said length resiliently stretchable between a relaxed state and an extended state.

10. The arm-training device of claim 9, said extended state generated from said relaxed state by the application of tensile force that acts on said elongate member along said length.

11. The arm-training device of claim 7, said length in a range of between about 30 inches to about 50 inches.

12. The arm-training device of claim 7, said elongate member having a width in a range of between about 1 inch to about 3 inches.

13. The arm-training device of claim 7, said elongate member generally planar.

14. An arm-training device comprising, a flexible elongate member having opposing first and second ends, wherein said elongate member has a continuous elastic length from said first end to said second end;

a first loop formed proximate said first end;

a second loop formed proximate said second end;

a first slide coupled to said first loop, said first slide movable along said length; and a second slide coupled to said second loop, said second slide movable along said length;

said second slide comprising a peripheral frame with an intermediate divider and outer sides defining laterally adjacent first and second openings;

said second end looped about said divider and fixedly secured to a portion of said elongate member.

15. The arm-training device of claim 14, said first end of said elongate member coupled to said first slide.

16. The arm-training device of claim 14, said length resiliently stretchable between a relaxed state and an extended state.

17. The arm-training device of claim 16, said extended state generated from said relaxed state by the application of tensile force that acts on said elongate member along said length.

18. The arm-training device of claim 14, said length in a range of between about 30 inches to about 50 inches.

19. The arm-training device of claim 14, said elongate member having a width in a range of between about 1 inch to about 3 inches.

20. The arm-training device of claim 14, said elongate member generally planar.

* * * * *